US009902170B2

(12) United States Patent
Zengo et al.

(10) Patent No.: US 9,902,170 B2
(45) Date of Patent: Feb. 27, 2018

(54) IRRADIATION DEVICE AND DROPLETS EJECTING DEVICE

(71) Applicant: FUJI XEROX CO., LTD., Tokyo (JP)

(72) Inventors: Takeshi Zengo, Kanagawa (JP); Akira Sakamoto, Kanagawa (JP); Hiroyuki Tsukuni, Kanagawa (JP); Jun Isozaki, Kanagawa (JP); Toshinobu Hamazaki, Kanagawa (JP); Yukari Motosugi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/376,813

(22) Filed: Dec. 13, 2016

(65) Prior Publication Data

US 2017/0368842 A1 Dec. 28, 2017

(30) Foreign Application Priority Data

Jun. 24, 2016 (JP) ..... 2016-125255

(51) Int. Cl.

| | |
|---|---|
| ***B41J 11/00*** | (2006.01) |
| ***B41J 2/355*** | (2006.01) |
| ***B41J 2/01*** | (2006.01) |
| ***B41J 2/435*** | (2006.01) |

(52) U.S. Cl.

CPC ..... *B41J 11/002* (2013.01); *B41J 2/01* (2013.01); *B41J 2/355* (2013.01); *B41J 2/435* (2013.01)

(58) Field of Classification Search

CPC ... B41J 2/0057; B41J 2/01; B41J 2/355; B41J 2/435; B41J 2202/20; B41J 11/002; B41F 23/0409; B41F 23/0443; B41F 23/045; B41F 23/0453; B41M 7/0081

See application file for complete search history.

(56) References Cited

U.S. PATENT DOCUMENTS 5,212,526 A * 5/1993 Domoto ..... G03G 8/00 399/298
7,712,890 B2 * 5/2010 Yahiro ..... B41J 2/0057 347/101

(Continued)

FOREIGN PATENT DOCUMENTS

JP 2004-223961 8/2004
JP 2010-208215 9/2010

(Continued)

OTHER PUBLICATIONS

Office Action issued in corresponding Japanese patent application No. 2016-125255, dated Jan. 24, 2017.

(Continued)

*Primary Examiner* — Anh T. N. Vo
(74) *Attorney, Agent, or Firm* — Fildes & Outland, P.C.

(57) ABSTRACT

An irradiation device includes: an irradiation unit that is disposed downstream of an ejection unit that ejects droplets, in a movement direction of a medium that is moved relative to the ejection unit so as to form a gap between the irradiation unit and the medium, and that irradiates, with light, droplets that have been ejected from the ejection unit and landed on the medium; and a transparent member that is shaped like a belt, transmits light, and is moved through the gap relative to the irradiation unit.

4 Claims, 6 Drawing Sheets

(56) References Cited

U.S. PATENT DOCUMENTS

| | | | | |
|---|---|---|---|---|
| 8,025,388 | B2 * | 9/2011 | Kadomatsu | B41J 2/0057 347/103 |
| 8,025,389 | B2 * | 9/2011 | Yamanobe | B41J 2/01 347/101 |
| 8,696,102 | B2 * | 4/2014 | Shimizu | B41J 2/0057 347/102 |
| 2006/0066704 | A1 * | 3/2006 | Nishida | B41J 2/0057 347/103 |
| 2011/0230623 | A1 * | 9/2011 | Hirano | B29C 35/10 525/309 |

FOREIGN PATENT DOCUMENTS

| | | |
|---|---|---|
| JP | 2011-46075 | 3/2011 |
| JP | 2011-126151 | 6/2011 |
| JP | 2015-147347 | 8/2015 |

OTHER PUBLICATIONS

English language translation of Office Action issued in corresponding Japanese patent application No. 2016-125255, dated Jan. 24, 2017.
Abstract and machine translation of JP 2011-126151.
Abstract and machine translation of JP 2010-208215.
Abstract and machine translation of JP 2004-223961.
Abstract and machine translation of JP 2011-46075.
Abstract and machine translation of JP 2015-147347.

* cited by examiner

IRRADIATION DEVICE AND DROPLETS EJECTING DEVICE

CROSS-REFERENCE TO RELATED APPLICATION

This application is based on and claims priority under 35 USC 119 from Japanese Patent Application No. 2016-125255 filed on Jun. 24, 2016.

BACKGROUND

Technical Field

The present invention relates to an irradiation device and a droplets ejecting device.

SUMMARY

According to an aspect of the invention, there is provided an irradiation device comprising: an irradiation unit that is disposed downstream of an election unit that ejects droplets, in a movement direction of a medium that is moved relative to the ejection unit so as to form a gap between itself and the medium, and that irradiates, with light, droplets that have been ejected from the ejection unit and landed on the medium; and a transparent member that is shaped like a belt, transmits light, and is moved through the gap relative to the irradiation unit.

BRIEF DESCRIPTION OF THE DRAWINGS

Exemplary embodiments of the present invention will be described in detail based on the following figures, wherein.

DESCRIPTION OF SYMBOLS

10: Droplets ejecting device
10A: Droplets electing device
10B: Droplets ejecting device
10C: Droplets ejecting device
10D: Droplets ejecting device
10E: Droplets ejecting device
32: Election unit
32Y: Ejection unit
32M: Ejection unit
32C: Ejection unit
32K: Ejection unit
34: Irradiation device
34Y: Irradiation device
34M: Irradiation device
34C: Irradiation device
34K: Irradiation device

36: Irradiation unit
36Y: Irradiation unit
36M: Irradiation unit
36C: Irradiation Unit
36K: Irradiation unit
50: First roll (example of first rotary body)
56: Second roll (example of second rotary body)
56A: Drive roll
A: Movement direction
B: Movement direction
BL: Blade (example of removing member)
BT: Transparent belt (example of transparent member)
BT1: Transparent belt (example of transparent member)
G: Gap
P: Medium

DETAILED DESCRIPTION

Modes for carrying out the present invention will hereinafter described as two (first and second) exemplary embodiments.

Exemplary Embodiment 1

Figure 1:
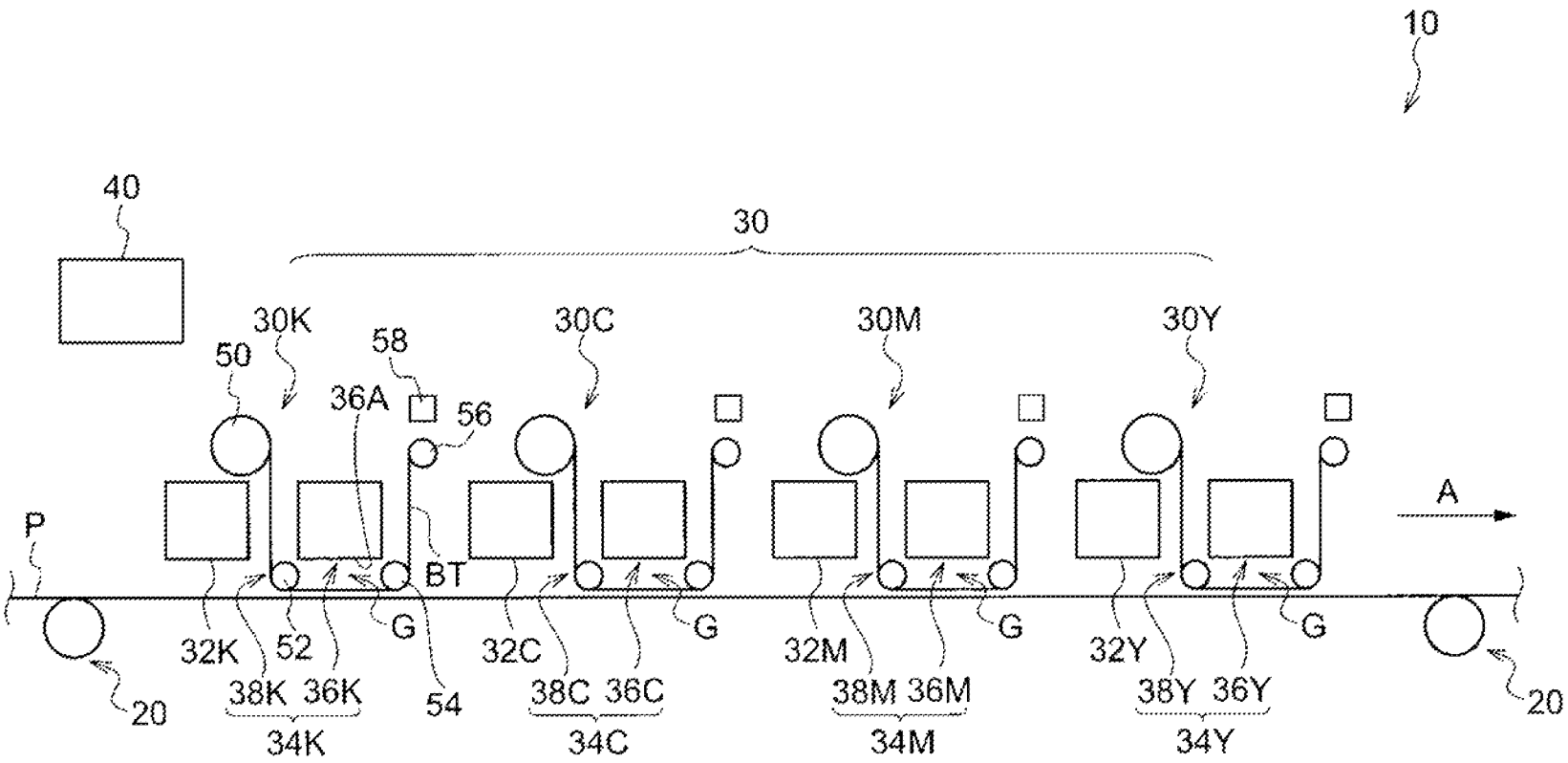
FIG. 1 is a front view outlining a droplets ejecting device according to a first exemplary embodiment of the present invention.

The configuration, an image forming operation, and advantages of a droplets ejecting device 10 according to a first exemplary embodiment will be described below in order with reference to FIG. 1. FIG. 1 is a front view of the droplets ejecting device 10 according to the first exemplary embodiment.

<Configuration>

The droplets electing device 10 according to this exemplary embodiment is an inkjet device which forms a final image on a medium P by forming an image of ink droplets (hereinafter referred to as an ink image) on the medium P and irradiating the ink image (i.e., ink droplets that have landed on the medium P) with light while conveying the medium P. The droplets ejecting device 10 includes a conveying unit 20, an image forming device 30, and a controller 40.

[Conveying Unit 20]

The conveying unit 20 has a function of conveying a medium P along a conveyance path. Arrow A in FIG. 1 indicates a feeding direction (movement direction) of a medium P being conveyed by the conveying unit 20 (this also applies to FIGS. 2-5). In the exemplary embodiment, the conveying unit 20 conveys a medium P in the device width direction of the droplets ejecting device 10. While a medium P is being conveyed by the conveying unit 20, it is moved relative to ejection units 32Y, 32M, 32C, and 32K (described later).

[Image Forming Device 30]

The image forming device 30 has a function of forming a final image by forming an ink image (i.e., an image composed of ink droplets) on a medium P and irradiating the ink image (i.e., ink droplets that have landed on the medium P) with light. To this end, the image forming device 30 is disposed so as to be opposed to (the front surface of) a medium P being conveyed. The image forming device 30 is equipped with image forming units 30Y, 30M, 30C, and 30K, which are the same in configuration except what relate to formation of ink images of different colors (e.g., Y (yellow), M (magenta), C (cyan), and K (black). The image forming units 30Y, 30M, 30C, and 30K are arranged in this order upstream in the medium movement direction.

The image forming units 30Y, 30M, 30C, and 30K include ejection units 32Y, 32M, 32C, and 32K and irradiation devices 34Y, 34M, 34C, and 34K, respectively. In the following description, as for the image forming units 30Y, 30M, 30C, and 30K, the ejection units 32Y, 32M, 32C, and 32K, and the irradiation devices 34Y, 34M, 34C, and 34K, the alphabetical characters Y, M, C, and K indicating the colors will be omitted if it is not necessary to discriminate between the units 30Y, 30M, 30C, and 30K, the units 32Y, 32M, 32C, and 32K, or the devices 34Y, 34M, 34C, and 34K.

[Ejection Unit 32]

Each ejection unit 32 has a function of forming an ink image of the associated color on a medium P being conveyed by the conveying unit 20 by electing ink droplets of the associated color toward the medium P. From another point of view, each ejection unit 32 has a function of ejecting ink droplets of the associated color toward a medium P being moved relative to the ejection unit 32 so that the droplets to constitute an ink image will land on the medium P.

Each ejection unit 32 is a member that is rectangular when viewed from the front side and extends a long distance in the device depth direction. Each ejection unit 32 is a line head (i.e., a head in which plural nozzles for ejecting droplets are arranged in the width direction of a medium P being conveved). For example, ink of the associated color of droplets to be ejected from each ejection unit 32 contains a solvent including water and a pigment (or dye) for producing the ink color.

[Irradiation Device 34]

Each irradiation device 34 has a function of irradiating, with light, an ink image that has been formed on a medium P by the corresponding ejection unit 32. From another point of view, each irradiation device 34 has a function of irradiating, with light, droplets that have been ejected from the corresponding ejection unit 32 and have landed on a medium P. The irradiation devices 34Y, 34M, 34C, and 34K include irradiation units 36Y, 36M, 36C, and 36K and cover units 38Y, 38M, 38C, and 38K, respectively. In the following description, as for the irradiation units 36Y, 36M, 36C, and 36K and the corner units 38Y, 38M, 38C, and 38K, the alphabetical characters Y, M, C and K indicating the colors will be omitted if it is not necessary to discriminate between the units 36Y, 36M, 36C, and 36K or the units 38Y, 38M, 38C, and 38K.

In the exemplary embodiment, the irradiation device 34Y is disposed downstream of the ejection unit 32Y in the medium movement direction. The irradiation device 34M is disposed downstream of the ejection unit 32M and upstream of the ejection unit 32Y in the medium movement direction. The irradiation device 34C is disposed downstream of the ejection unit 32C and upstream of the election unit 32M in the medium movement direction. The irradiation device 34K is disposed downstream of the ejection unit 32K and upstream of the ejection unit 32C in the medium movement direction.

(Irradiation Unit 36)

Each irradiation unit 36 is a member that is rectangular when viewed from the front side and extends a long distance in the device depth direction. Each irradiation unit 36 is configured so as to irradiate, with light, a medium P in the entire range in its width direction in which droplets ejected from the corresponding ejection unit 32 can land. More specifically, each irradiation unit 36 is disposed so as to form a gap G between itself and a medium P being conveyed (i.e., the movement path plane of a medium P) and to irradiate (the front surface of) a medium P with a rectangular light beam that is emitted from a light source (not shown) installed on a surface 36A opposed to the medium P and is long in the medium width direction.

When droplets that have landed on a medium P are irradiated with light emitted from each irradiation unit 36, the solvent contained in the droplets evaporates and the pigment (or dye) also contained in the droplets is fixed onto the medium P (i.e., an ink image is formed on the medium P).

(Cover Unit 38)

Each cover unit 38 has a function of suppressing a phenomenon that floating substances that flow into the gap G between the corresponding irradiation unit 36 and a medium P as the medium P is moved stick to the light source of the irradiation unit 36. The term "floating substances" means foreign substances such as an ink mist that is produced when the ejection units 32 eject droplets and a paper powder produced from media P.

Each corner unit 38 includes a transparent belt BT, a first roll 50, driven rolls 52 and 54, a second roll 56, and a drive source 58. The transparent belt BT is an example of a transparent member, the first roll 50 is an example of a first rotary body, and the second roll 56 is an example of a second rotary body. The first roll 50, the driven rolls 52 and 54, and the second roll 56 are positioned with respect to the body of the droplets ejecting device 10 in a state that their axial directions are set parallel with the width direction of a medium P to be conveyed.

The lengths of the first roll 50, the driven rolls 52 and 54, and the second roll 56 and the width of the transparent belt BT are greater than the width (longitudinal length) of the irradiation unit 36 and stick out of both ends of the irradiation unit 36 in its longitudinal direction. In FIG. 1, the components of each of the cover units 38 other than the cover unit 38K which is part the image forming unit 30K are not given reference symbols.

The first roll 50 is disposed upstream, in the medium movement direction, of and above the corresponding irradiation unit 36. The outer circumferential surface of the first roll 50 is wound with the transparent belt BT. The first roll 50 is rotatable about its axis.

The driven roll 52 is disposed upstream, in the medium movement direction, and below the corresponding irradiation unit 36 and above a medium P being conveyed. The driven roll 54 is disposed downstream, in the medium movement direction, of and below the corresponding irradiation unit 36 and above a medium P being conveyed. The outer circumferential surfaces of the driven rolls 52 and 54 are wound with the transparent belt BT.

The second roll 56 is disposed downstream, in the medium movement direction, of and above the corresponding irradiation unit 36. One end of the transparent belt BT is fixe to the outer circumferential surface of the second roll 56. The second roll 56 is rotated by the corresponding drive source 58 about its axis.

In each cover unit 38 having the above configuration, when the second roll 56 is rotated by the drive source 58, the transparent belt BT is moved while it maintains a U shape that surrounds the corresponding irradiation unit 36 when viewed from the front side of the droplets ejecting device 10. More specifically, a portion, paid out of the first roll 50, of the transparent belt BT is moved through the gap G while being wound on the driven rolls 52 and 54 and opposed to the corresponding irradiation unit 36, and is then taken up by the second roll 56. In the exemplary embodiment each cover unit 38 is a replaceable component.

As described above, each irradiation unit 36 has a function of irradiating, with light, droplets that have been ejected from the corresponding ejection unit 32 and landed on a medium P. And each cover unit 38 has a function of suppressing a phenomenon that floating substances that flow into the gap G as a medium P is moved stick to the right source of the irradiation unit 36.

[Controller 40]

The controller 40 has a function of controlling the devices and units (other than itself) that constitute the droplets ejecting device 10. The function of the controller 40 will be described later in describing an image forming operation of the droplets ejecting device 10.

<Image Forming Operation>

Next, an image forming operation of the droplets ejecting device 10 will be described with reference to FIG. 1.

Upon receiving job data from an external apparatus (not shown), the controller 40 puts the conveying unit 20 and the image forming device 30 into operation. More specifically, the controller 40 causes the conveying unit 20 to convey a medium P at a prescribed speed in the feeding direction. The controller 40 causes each ejection unit 32 to eject droplets of the associated color with timing to form an ink image of that color on the medium P by the ejection unit 32. The controller 40 causes each irradiation unit 36 to irradiate, with light, the droplets that have been ejected from the corresponding ejection unit 32 and landed on the medium P. And the controller 40 causes the drive source 58 of each cover unit 38 to rotate the second roll 56 so that a portion of the transparent belt BT is paid out of the first roll 50 and then taken up by the second 56. Thus, while each irradiation unit 36 is irradiating the droplets that have landed on the medium P with light, a portion of the corresponding transparent belt BT is moved through the gap G.

The image forming operation of the droplets ejecting device 10 according to the exemplary embodiment is finished after the medium P has passed the image forming unit 30Y and the pigment (or dye) contained in the droplets of each color has been fixed on the medium P.

<Advantages>

Next, advantages of the exemplary embodiment, which are obtained because the irradiation unit 36 of each irradiation device 34 is equipped with the transparent belt BT which is moved through the gap G between the irradiation unit 36 and a medium P being conveyed, will be described by comparing the exemplary embodiment with a comparative mode. The comparative mode will be described using components etc. (i.e., their names and reference symbols) of the exemplary embodiment though no drawings will be used for the description of the comparative mode.

In the comparative mode, each irradiation device (not shown) is equipped with a transparent plate (transparent member) in place of the cover unit 38. The transparent plate is disposed in the gap G and occupies the entire range of the irradiation unit 36 in a top view, and fixed to the irradiation unit 36. The comparative mode is the same as the exemplary embodiment in configuration except for the above.

If an image forming operation is performed using the droplets electing device of the comparative mode, floating substances that flow into the gap G as a medium P is moved stick to the transparent plate. Light that is emitted from the irradiation unit 36 and reaches floating-substance-stuck portions of the transparent plate are scattered, reflected, or influenced otherwise by the floating substances. As a result, variations occur in the quantity of light that reaches the irradiation area of the medium P (i.e., the entire range in which droplets elected from the ejection unit 32 can land) due to the floating substances stuck to the transparent plate (occurrence of a light transmission failure). As a result, the amount of evaporation of the solvent, contained in part of the droplets that have landed on the medium P is decreased to produce image specks (image formation failure). The image formation failure becomes more noticeable as the period of use of the droplets ejecting device becomes longer.

In contrast, in the exemplary embodiment, since each irradiation device 34 is equipped with the transparent belt BT which is moved through the gap G between the irradiation unit 36 and a medium P being conveyed, a new portion (i.e., a portion that has not been moved through the gap G) of the transparent belt BT is paid out of the first roll 50 and placed in the gap G. Floating substances that have stuck to a portion the transparent belt BT in the gap G are moved together with that portion of the trans parent belt BT and put into the second roll 56.

As described above, in each irradiation device 34 according to the exemplary embodiment, a new portion of the transparent belt BT is placed in the gap G because of a movement of the transparent belt BT. As a result, in each irradiation device 34 according to the exemplary embodiment, the amount of substances that stick to a portion, placed in the gap G between the irradiation unit 36 and a medium P, of the transparent belt BT is smaller than in the comparative mode in which the transparent member disposed in the gap G is not moved. Thus, in the droplets ejecting device 10 according to the exemplary embodiment, the probability of occurrence of a light transmission failure is much lower than in the comparative mode in which the transparent member placed the gap G is not moved.

Exemplary Embodiment 2

A second exemplary embodiment of the invention will described below with reference to FIG. 2. Only differences from the first exemplary embodiment will be described below. The second exemplary embodiment will be described using components etc. (i.e., their names and reference symbols) of the first exemplary embodiment.

<Configuration>

Figure 2:
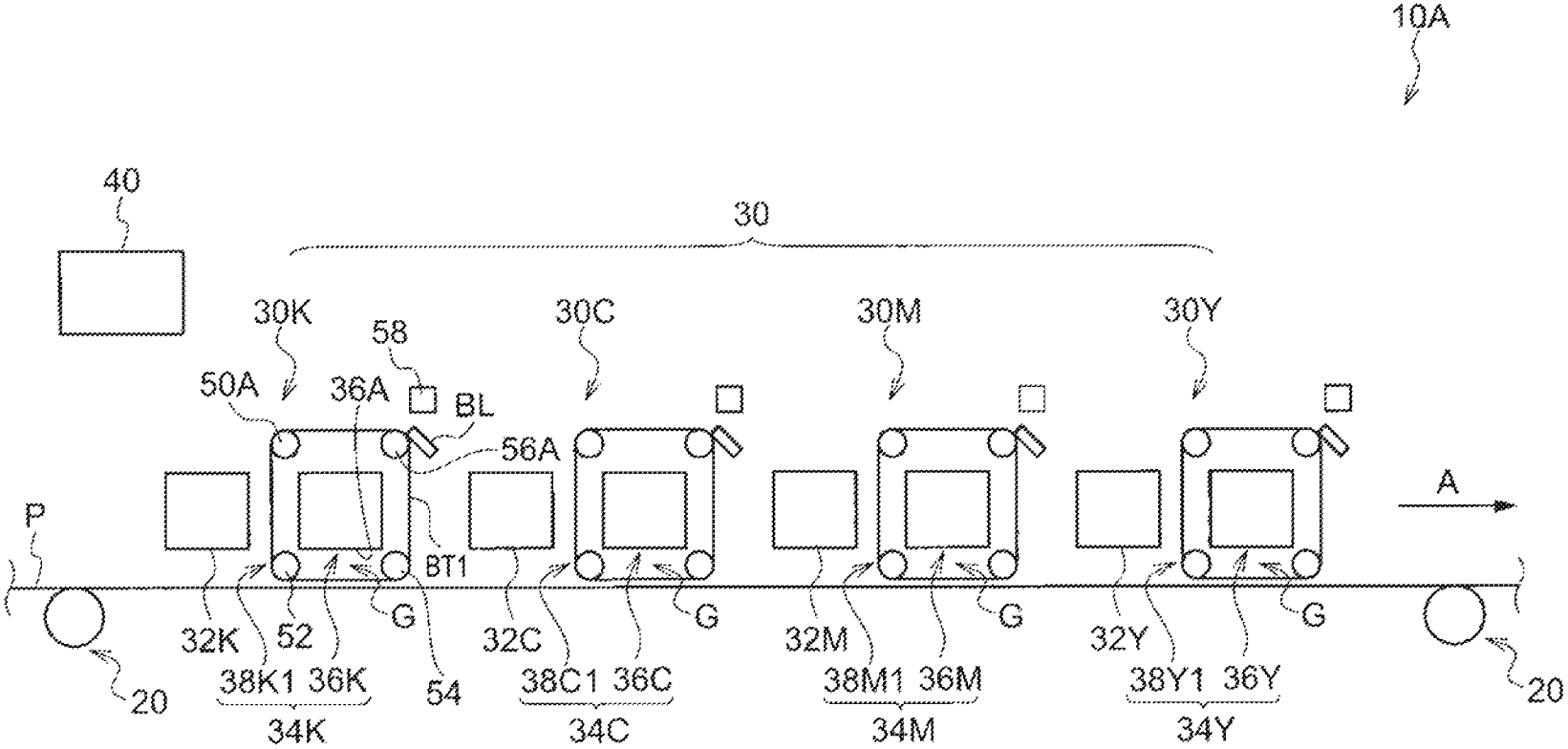
FIG. 2 is a front view outlining a droplets ejecting device according to a second exemplary embodiment of the invention.
Figure 3:
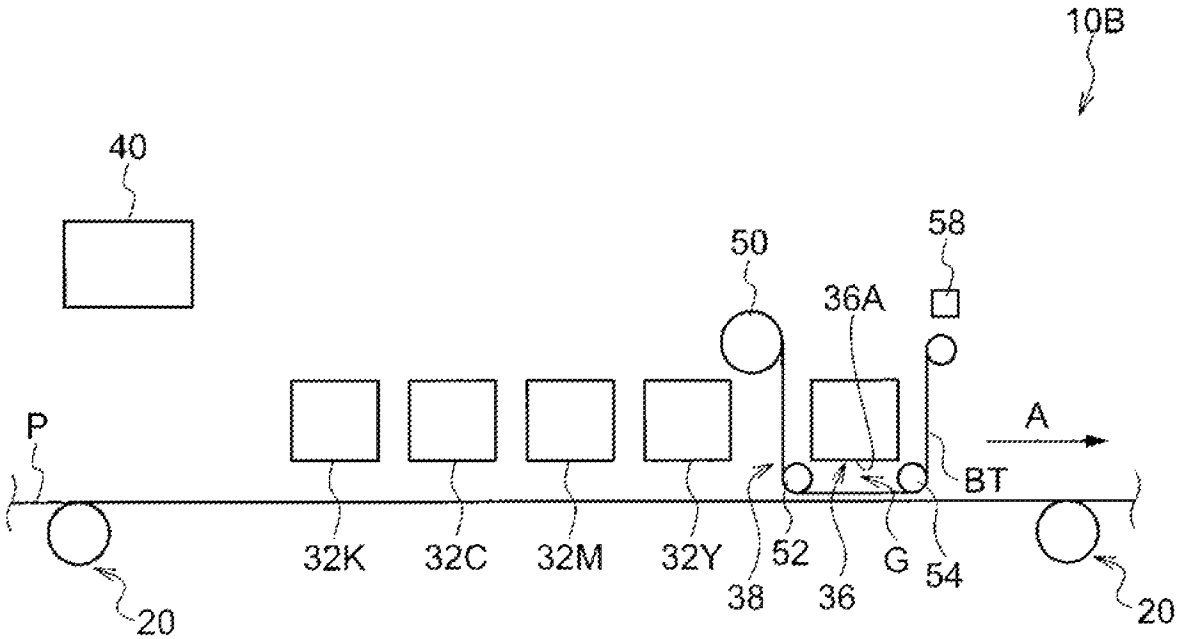
FIG. 3 is a front view outlining a droplets ejecting device according to a first modification.

A droplets ejecting device 10A shown in FIG. 2 according to the second exemplary embodiment is different from the droplets ejecting device 10 according to the first exemplary embodiment in the configuration of cover units 38Y1, 38M1, 38C1, and 38K1. More specifically, in this exemplary embodiment, a transparent belt BT1, which is an example of the transparent member, is an endless belt. In the exemplary embodiment, a driven roll 50A is provided in place of the first roll 50 and a drive roll 56A is provided in place of the second roll 56. The transparent belt BT1 is wound on the driven rolls 50A, 52, 54, and the drive roll 56A, and circulates counterclockwise (when the droplets ejecting vice 10A is viewed from the front side) as the drive roll 56A is rotated by the drive source 58. The drive roll 56A is an example of a circulation causing member.

Each irradiation device 34 (the droplets ejecting device 10A) according to the exemplary embodiment is equipped with a blade BL which is in contact with the outer circumferential surface of the transparent belt BT1 on the opposite side of the transparent belt BT1 to the drive roll 56A and thereby removes substances sticking to the outer circumferential surface of the transparent belt BT1. The blade BL is an example of a removing member. The second exemplary embodiment is the same in configuration as the first exemplary embodiment except for the above.

<Image Forming Operation>

In the exemplary embodiment, in an image forming operation, as the drive source 58 rotates the drive roll 56A, the transparent belt BT1 circulates while floating substances sticking to the outer circumferential surface of the transparent belt BT1 are raked up by the blade BL. As a result, a portion, having been moved through the gap G (i.e., passed the irradiation unit 36), of the transparent belt BT1 is subjected to removal of floating substances by the blade BL (resetting of the state that floating substances are stuck to its outer circumferential surface is reset), and is then moved through the gap G again. The image forming operation of the second exemplary embodiment is the same as that of the first exemplary embodiment except for the above.

<Advantages>

The second exemplary embodiment is different from the first exemplary embodiment in that the transparent belt BT1 circulates while floating substances that have been stuck to it in the gap G are raked up by the blade BL. The cover units 38Y1, 38M1, 38C1, and 38K1 (irradiation devices 34Y, 34M, 34C, and 34K) are longer in device life (i.e., replacement interval) than in the case that a portion, having been moved through the gap G between the irradiation unit 36 and a medium P, of the transparent belt BT is taken up rather than circulated. Furthermore, it can be said that in each irradiation device 34 according to the second exemplary embodiment, the amount of substances sticking to a portion, placed in the gap G, of the transparent belt BT1 is smaller than in a case that a transparent member that is disposed in the gap G as in the above-described comparator mode is not moved relative to the irradiation unit 36.

Although the invention has been described above in the form of the particular exemplary embodiments, the invention is not limited to those exemplary embodiments. For example, the technical scope of the inventions encompasses the following modes.

In the first exemplary embodiment, the transparent belt BT is paid out of the first roll 50 and taken up by the second roll 56, the first roll 50 is disposed upstream of the irradiation unit 36 in the medium movement direction, and the second roll 56 is disposed downstream of the irradiation unit 36 in the medium movement direction. However, the positions of the first roll 50 and the second roll 56 may be interchanged. In this case, the first roll 50 is an example of the second rotary body and the second roll 56 is an example of the first rotary body.

In each exemplary embodiment, as shown in FIGS. 1 and 2, each irradiation device 34 for irradiating, with light, droplets that have been ejected from the corresponding ejection unit 32 and landed on a medium P is disposed downstream of the election unit 32 in the medium movement direction. However, as in a droplets ejecting device 10B according to a first modification shown in FIG. 3, a final image may be formed in such a manner that a single irradiation device 34 that is disposed downstream of all of the ejection units 32 in the medium movement direction irradiates, with light, sets of droplets of the respective colors that have been ejected from the plural ejection units 32.

Although the irradiation device 34 according to the first modification corresponds to each irradiation device 34 according to the first exemplary embodiment (see FIG. 1), another irradiation device 34 according to the first modification is possible that corresponds to each irradiation device 34 according to the second exemplary embodiment (see FIG. 2). Furthermore, a droplets ejecting device having only one ejection unit 32 (e.g., monochrome machine) is possible.

Figure 4:
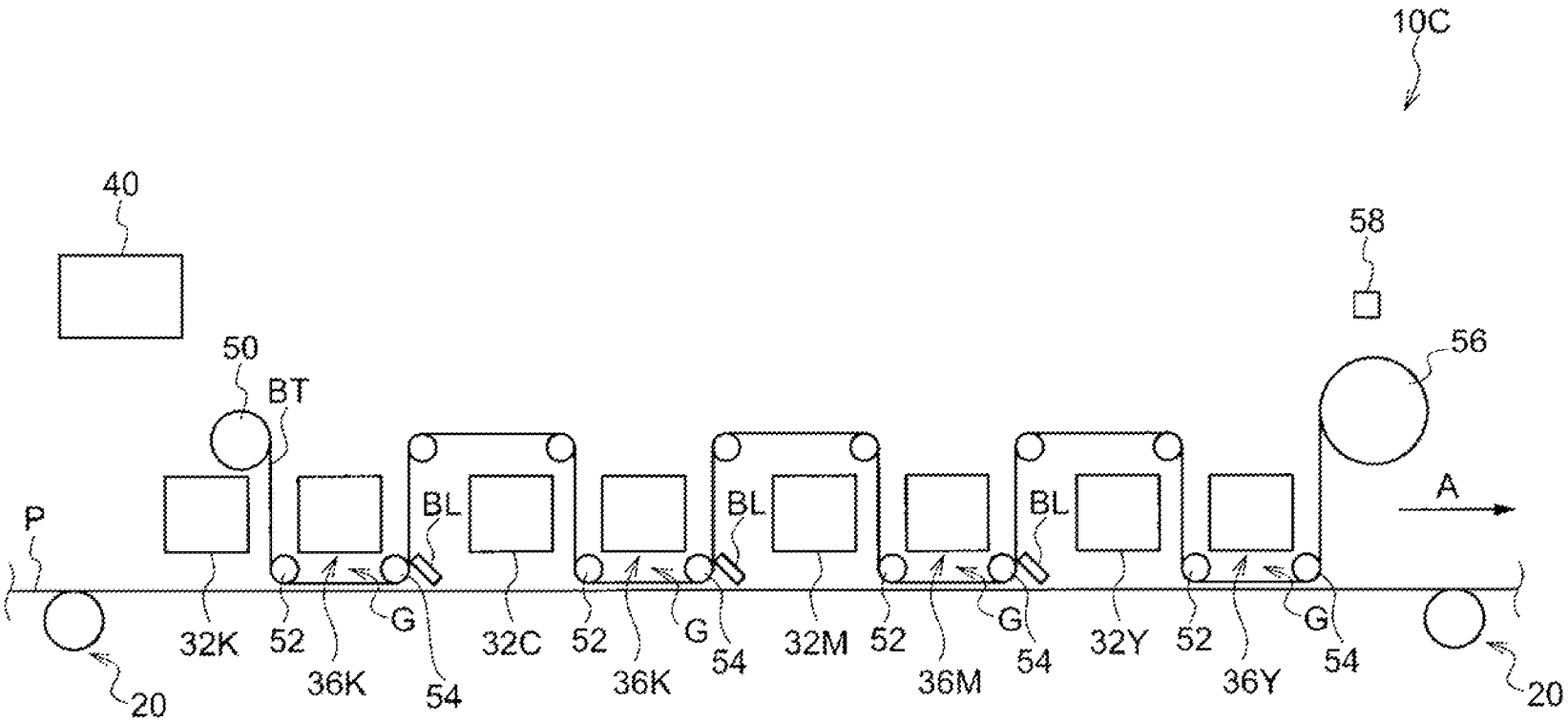
FIG. 4 is a front view outlining a droplets ejecting device according to a second modification.

In each exemplary embodiment, as shown in FIGS. 1 and 2, each irradiation device 34 for irradiating, with light, droplets that have been ejected from the corresponding ejection unit 32 and landed on a medium P is disposed downstream of the ejection unit 32 in the medium movement direction and the cover unit 38 is driven by the drive source 58. However, as shown in FIG. 4, a droplets ejecting device 10C according to a second modification is possible in which a transparent belt BT is paid out of a first roll 50 is moved through the gaps G adjacent to all of the irradiation units 36 and then taken up by a second roll 56.

More specifically, one of the first roll 50 and the second roll 56 disposed upstream of the irradiation unit 36K which is located most upstream in the medium movement direction among all of the irradiation units 36 and the other is disposed downstream of the irradiation unit 36Y which is located motif downstream in the medium movement direction. The second roll 56 takes up a portion, having been moved through the respective gaps G adjacent to call of the irradiation units 36, of the transparent belt BT.

In the second modification, a blade BL for removing substances sticking to the outer circumferential surface of the transparent belt BT is disposed between the image forming units 30Y and 30M, between the image forming units 30M and 30C, and between the image forming units 30C and 30K.

In the second modification, the number of components is smaller (one drive source 58) than in the case that one cover unit 38 is provided for each ejection unit 32 (e.g., four drive sources 58).

Another configuration is possible in which one irradiation device 34 is provided for the ejection units 32Y, 32M, and 32C each of which ejects color droplets and another irradiation device 34 is provided for the ejection units 32K which ejects black droplets.

Figure 5:
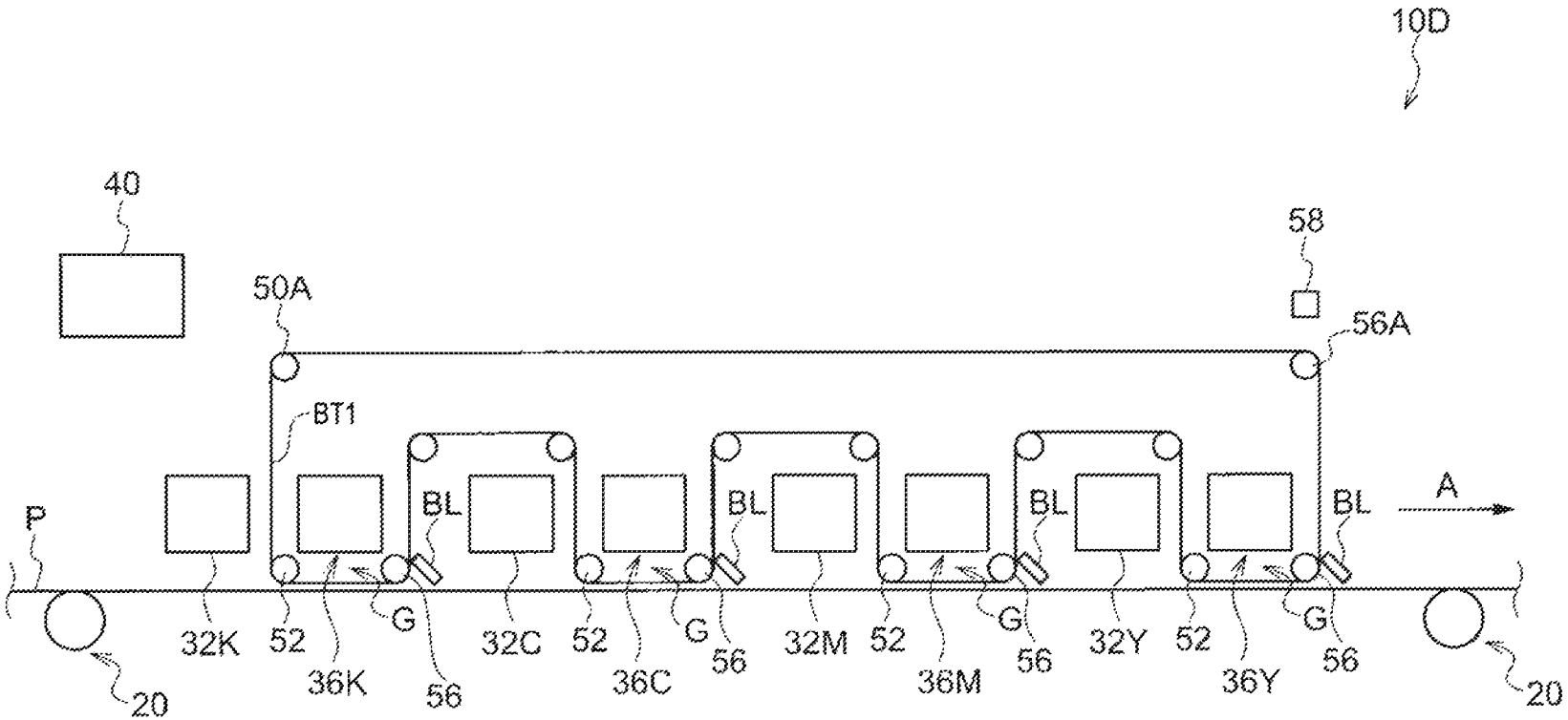
FIG. 5 is a front view outlining a droplets electing device according to a third modification.

FIG. 5 shows a droplets ejecting device 100 according to a third modification which is a combination of the concept of the second exemplary embodiment that the endless transparent belt BT1 is circulated (see FIG. 2) and the concept of the second modification that the transparent belt BT is moved by the single drive source 58 (see FIG. 4). More specifically, a drive roll 56A circulates a transparent belt BT1 along a circulation path including, as its portions, the respective gaps G adjacent to all of the irradiation units 36. In the third modification, the number of components is smaller than in the case that the transparent belt BT1 is a circulated for each irradiation unit 36.

Figure 6:
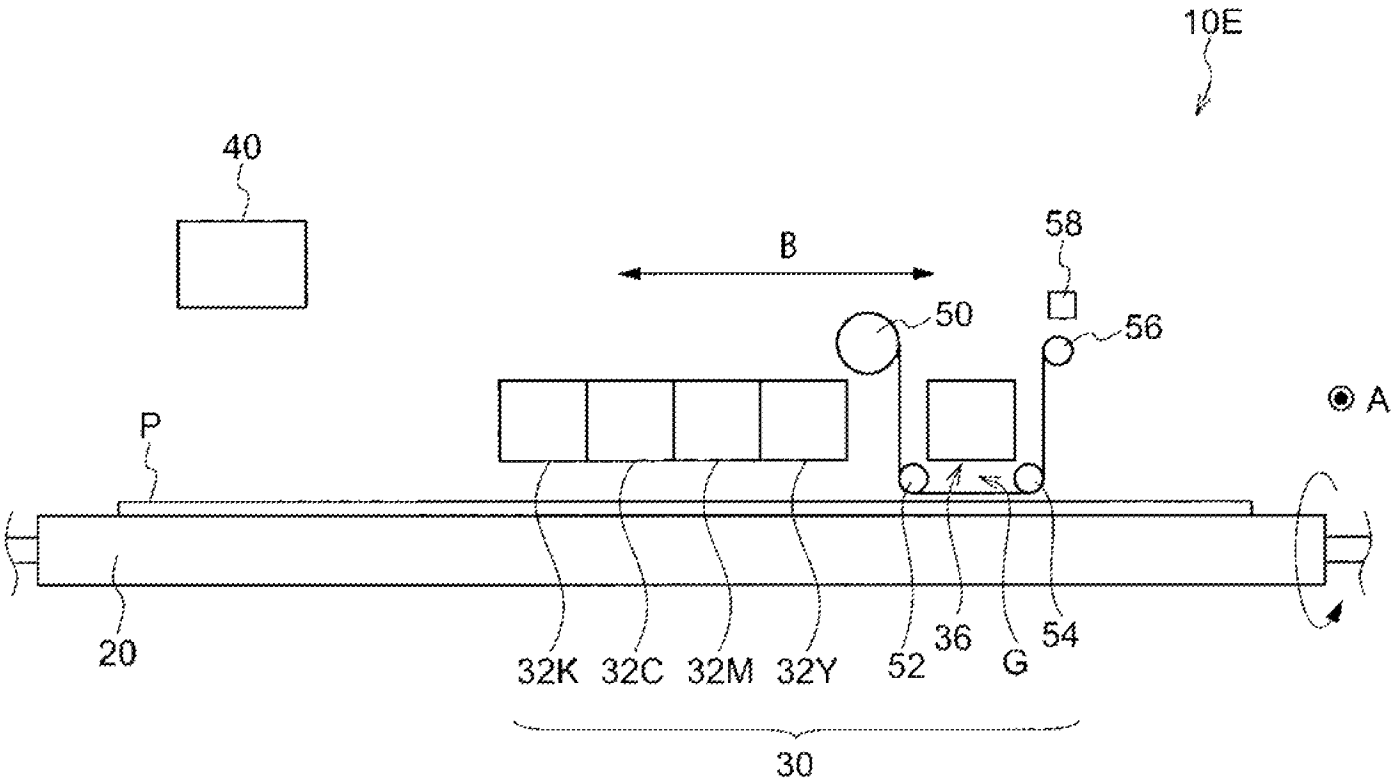
FIG. 6 is a front view outlining a droplets ejecting device according to a fourth modification.

The droplets ejecting device 10 and 10A according to the exemplary embodiments (see FIGS. 1 and 2) and the droplets ejecting device 10B, 10C, and 10D according to the modifications (see FIGS. 3, 4, and 5) are line head type inkjet devices in which each ejection unit 32 is a line head. On the other hand, FIG. 6 shows a droplets ejecting device 10E according to a fourth modification which is what is called a serial head type inkjet device and in which a final image is formed by reciprocating a serial head type image forming device 30 (ejection units 32 and an irradiation device 34) in the direction (indicated by arrow B in FIG. 6) that is perpendicular to the medium movement direction.

Each exemplary embodiment employs inks each of which contains, for example, a solvent including water and a pigment (or dye) for producing an ink color. However, an ink jet device is possible that employs different kinds of inks than employed in the exemplary embodiments as long as each ejection unit 32 forms a final image by ejecting droplets toward a medium P being moved relative to the ejection unit 32 and irradiating, with light, droplets that are stuck to the medium P. For example, the inks may be what is called ultraviolet-curing inks.

The type of light with which to irradiate droplets that are stuck to a medium P may be selected (or set) according to an ink used. For example, infrared light is suitable for droplets of a water-based ink and ultraviolet light is suitable for droplets of an ultraviolet-curing ink.

What is claimed is:

1. An irradiation device comprising:

a plurality of irradiation units that are each disposed downstream of an ejection unit that ejects droplets, in a movement direction of a medium that is moved relative to the ejection unit so as to form a gap between the irradiation unit and the medium, and that irradiates, with light, droplets that have been ejected from the ejection unit and landed on the medium, the plurality of irradiation units being arranged along the movement direction;

a transparent member that is shaped like a belt, transmits light, and is moved through the gap relative to the irradiation unit;

a first rotary body that is rotatable about an axis and whose outer circumferential surface is wound with the transparent member; and a second rotary body that is rotated about an axis and thereby takes up a portion of the transparent member that is paid out of the first rotary body as a result of the rotation of the second rotary body and having been moved through respective gaps adjacent to all of the plurality of irradiation units;

one of the first rotary body and the second rotary body being disposed upstream of an irradiation unit, located most upstream in the movement direction, of all of the plurality of irradiation units in the movement direction;

other of the first rotary body and the second rotary body being disposed downstream of an irradiation unit, located most downstream in the movement direction, of all of the plurality of irradiation units in the movement direction.

2. A droplets ejecting device comprising:

the irradiation device according to claim 1; and an ejection unit that is disposed upstream of the irradiation unit and ejects droplets toward the medium.

3. An irradiation device comprising:

a plurality of irradiation units that are each disposed downstream of an ejection unit that ejects droplets, in a movement direction of a medium that is moved relative to the ejection unit so as to form a gap between the irradiation unit and the medium, and that irradiates, with light, droplets that have been ejected from the ejection unit and landed on the medium, the plurality of irradiation units being arranged along the movement direction;

a transparent member that is an endless member shaped like a belt, transmits light, and is moved through the gap relative to the irradiation unit;

a circulation causing member that circulates the transparent member along a circulation path including, as portions of the circulation path, the respective gaps adjacent to all of the plurality of irradiation units; and a removing member that is in contact with an outer circumferential surface of the transparent member and thereby removes substances sticking to the outer circumferential surface.

4. A droplets ejecting device comprising:

the irradiation device according to claim 3; and an ejection unit that is disposed upstream of the irradiation units and ejects droplets toward the medium.

* * * * *